US009738954B2

(12) United States Patent
Sumi et al.

(10) Patent No.: US 9,738,954 B2
(45) Date of Patent: Aug. 22, 2017

(54) TURBINE WHEEL OF AUTOMOTIVE TURBOCHARGER AND METHOD FOR PRODUCING THE SAME

(71) Applicants: Yoshinori Sumi, Aichi (JP); Hiroyuki Takabayashi, Aichi (JP)

(72) Inventors: Yoshinori Sumi, Aichi (JP); Hiroyuki Takabayashi, Aichi (JP)

(73) Assignee: DAIDO STEEL CO., LTD., Aichi (JP)

( * ) Notice: Subject to any disclaimer, the term of this patent is extended or adjusted under 35 U.S.C. 154(b) by 367 days.

(21) Appl. No.: 14/631,107

(22) Filed: Feb. 25, 2015

(65) Prior Publication Data

US 2015/0247221 A1 Sep. 3, 2015

(30) Foreign Application Priority Data

Feb. 28, 2014 (JP) ..... 2014-039504
Dec. 12, 2014 (JP) ..... 2014-252173

(51) Int. Cl.
*B22D 18/06* (2006.01)
*C22C 19/05* (2006.01)
*F01D 5/28* (2006.01)

(52) U.S. Cl.
CPC ..... *C22C 19/056* (2013.01); *B22D 18/06* (2013.01); *F01D 5/28* (2013.01)

(58) Field of Classification Search
CPC ..... B22D 18/06; F01D 5/28; C22C 19/056
See application file for complete search history.

(56) References Cited

U.S. PATENT DOCUMENTS 3,524,744 A * 8/1970 Parikh ..... B22F 9/06 419/15
3,802,938 A * 4/1974 Collins ..... C22F 1/10 148/677
3,832,167 A * 8/1974 Ker Shaw ..... C22C 19/007 420/447
3,964,877 A * 6/1976 Bessen ..... C22C 1/0433 277/411

(Continued)

FOREIGN PATENT DOCUMENTS

GB 1332160 A 10/1973
JP 60-258444 A 12/1985

(Continued)

OTHER PUBLICATIONS

European Search report issued with respect to application No. 15156726.0, mail date is Jul. 16, 2015.

*Primary Examiner* — Colleen Dunn
(74) *Attorney, Agent, or Firm* — Greenblum & Bernstein, P.L.C.

(57) ABSTRACT

The present invention relates to a turbine wheel of an automotive turbocharger, including a Ni-based alloy having a composition which contains, in terms of mass %: C: 0.08 to 0.20%; Mn: 0.25% or less; Si: 0.01 to 0.50%; Cr: 12.0 to 14.0%; Mo: 3.80 to 5.20%; Nb+Ta: 1.80 to 2.80%; Ti: 0.50 to 1.00%; Al: 5.50 to 6.50%; B: 0.005 to 0.015%; Zr: 0.05 to 0.15%; and Fe: 0.01 to 2.5%, with the remainder being Ni and unavoidable impurities, in which the turbine wheel includes a wing part and a shaft part, and a size of γ' phase in each site of from a tip of the wing part to the shaft part is structure-controlled so as to fall within a range of from 0.4 to 0.8 μm.

16 Claims, 3 Drawing Sheets

(56) References Cited

U.S. PATENT DOCUMENTS

| | | | | | |
|---|---|---|---|---|---|
| 4,066,449 | A * | 1/1978 | Havel | B22F 9/04 | 419/32 |
| 4,139,376 | A * | 2/1979 | Erickson | B22F 3/002 | 277/411 |
| 4,226,644 | A * | 10/1980 | Cox | C22C 1/0433 | 148/410 |
| 4,468,945 | A * | 9/1984 | Fairey | B21C 25/025 | 72/253.1 |
| 4,530,727 | A * | 7/1985 | Thompson | C22C 19/03 | 148/281 |
| 4,915,907 | A * | 4/1990 | Shah | C30B 11/00 | 148/404 |
| 5,298,052 | A * | 3/1994 | Tanaka | F16C 33/121 | 419/11 |
| 5,783,318 | A * | 7/1998 | Biondo | B23K 35/3033 | 148/512 |
| 7,824,606 | B2 * | 11/2010 | Heazle | C22C 19/057 | 148/428 |

FOREIGN PATENT DOCUMENTS

| | | | |
|---|---|---|---|
| JP | 01-255635 | A | 10/1989 |
| JP | 04-358037 | A | 12/1992 |
| JP | 06-041664 | A | 2/1994 |

* cited by examiner

TURBINE WHEEL OF AUTOMOTIVE TURBOCHARGER AND METHOD FOR PRODUCING THE SAME

FIELD OF THE INVENTION

The present invention relates to a turbine wheel of an automotive turbocharger and a method for producing the same, particularly relates to a turbine wheel including a Ni-based alloy and a method for producing the same.

BACKGROUND OF THE INVENTION

In recent years, a turbocharger that is greatly effective to improvement of fuel efficiency is widely used in an automotive engine, particularly an automotive diesel engine, in strongly demanding improvement of fuel efficiency.

Turbocharger rotates a turbine wheel utilizing an exhaust gas from an engine to drive a compressor wheel provided on the same shaft, thereby supplying high pressure air to the engine.

FIG. 3A shows a structure of a general automotive turbocharger.

As shown in FIG. 3A, a turbocharger 10 has a turbine wheel 14 in a turbine housing 12 and a compressor wheel 18 in a compressor housing 16, and the turbine wheel 14 and the compressor wheel 18 are integrally connected in a rotational state by a common rotor shaft 20.

In the turbocharger 10, an exhaust gas from an engine is allowed to flow into the turbine housing 12 to rotate the turbine wheel 14 by the exhaust gas, thereby integrally rotating the compressor wheel 18 in the compressor housing 16.

Air is sucked into the compressor housing 16 by rotation of the compressor wheel 18 and pressurized, and high pressure air is supercharged to an engine.

FIG. 3B shows a shape of the turbine wheel 14 in more detail.

As shown in the drawing, the turbine wheel 14 includes a shaft part 22 of a rotation center and a plurality of wing parts 24 radially projected from the shaft part 22, and thus has a complicated shape as a whole.

Furthermore, the thickness thereof differs between the shaft part 22 and the wing parts 24. That is, the thickness is large in the shaft part 22 of rotation center, and the thickness is small in the wing parts 24.

Additionally, even in the wing parts 24, the thickness differs in each site. That is, the thickness is large in a root portion near the shaft part 22, and the thickness becomes smaller towards a tip of the wing part 24.

In the case of the turbine wheel 14 of an automotive turbocharger, the thickness is 1 mm or less in the portion having the smallest thickness.

A turbine wheel that rotates by receiving exhaust from an engine rotates at high speed (for example, the number of revolution per minute is hundreds of thousands) under high temperature (for example, under high temperature of about 950° C.). Therefore, the turbine wheel is required to have high strength at high temperature.

For this reason, a Ni-based alloy having excellent high temperature strength, particularly a Ni-based casting alloy represented by INCONEL 713C (trade name of International Nickel Company) has conventionally been mainly used as a material of a turbine wheel.

In the case of a Ni-based alloy having excellent high temperature strength, γ' phase (gamma prime phase) (phase of $Ni_3(Al,Ti,Nb)$ of an intermetallic compound) precipitated as a strengthening phase is stable up to high temperature. Therefore, it is difficult to produce a turbine wheel by forging, and generally, a turbine wheel is cast mainly using a Ni-based casting alloy and is used as it is (as-cast state).

A turbine wheel is used under severe conditions such as high speed rotation under high temperature and rapid change of the number of revolution, and is therefore required to have characteristics on strength. In addition to this, in the case of casting using a Ni-based casting alloy, it is first important that when casting, a melt arrives in every corner of a product (in every corner of molding cavities) without solidifying the melt in the course of casting, whereby a beautiful product shape can be formed, and blow holes are not formed in the inside of the product. Conventionally, it was actual situation that production conditions for mainly achieving those have been pursued.

On the other hand, it is viewed as problematic that regarding high temperature strength, deviation occurs among products, and to pursue its cause, observation of the state of carbide and crystal grain has been mainly made, but the solution has not been achieved. Thus, the problems have still remained on occurrence of deviation and difference in high temperature strength.

As the background art to the present invention, the invention regarding an "alloy for an anvil" is shown in Patent Document 1 mentioned below, and it discloses an alloy for an anvil having a composition including, in terms of % by weight, C: 0.008 to 0.3%, Si: 0.1 to 0.5%, Mn: 0.1 to 0.25%, Cr: 8.0 to 22.0%, Mo: 3.5 to 10.0%, Nb+Ta: 1.5 to 5.0% in total, Al: 5.0 to 6.50%, Ti: 0.5 to 3.0%, Zr: 0.05 to 0.15%, B: 0.005 to 0.015% with the remainder being Ni. However, Patent Document 1 does not contain the description that high temperature strength is enhanced by controlling a size of γ' phase in each site of a product, and therefore differs from the present invention.

Patent Document 2 discloses the invention relating to a "heat resistant elastic machine element and method for producing the same", and it is disclosed therein that a plate-shaped heat resistant elastic machine element is formed by precision casting (reduced pressure suction casting method using a lost wax mold) using a Ni-based super heat-resistant alloy material having given components.

Patent Document 3 shows the invention relating to a "nickel-based heat-resistant alloy", and a Ni-based heat-resistant alloy prepared such that $(Al,Cr)_2O_3$ coating film is formed on the surface thereof by adding Al and Cr in combination is disclosed therein.

Patent Document 4 shows a "heat-resistant alloy", and discloses a Ni-based heat-resistant alloy that enabled casting and molding of a complicated shape part having excellent high temperature creep characteristic by adding 0.20% or less of REM (Rare Earth Metal) in order to eliminate adverse influence of Se contained in a melting raw material to creep rupture strength.

However, those Patent Documents 2 to 4 do not contain the description that high temperature strength is enhanced by controlling a size of γ' phase in each site of a product, and therefore differ from the present invention.

Patent Document 1: JP-A-1-255635
Patent Document 2: JP-A-6-41664
Patent Document 3: JP-A-4-358037
Patent Document 4: JP-A-60-258444

SUMMARY OF THE INVENTION

Based on the above-described circumstances as background, the present invention has been made for the purpose of providing a turbine wheel of an automotive turbocharger including a Ni-based alloy having high reliability of durability life, in which stable high temperature strength is obtained, and a method for producing the same.

Namely, the present invention relates to the following (1) to (5).

(1) A turbine wheel of an automotive turbocharger, including a Ni-based alloy having a composition which contains, in terms of mass %:

C:0.08 to 0.20%;
Mn: 0.25% or less;
Si: 0.01 to 0.50%;
Cr: 12.0 to 14.0%;
Mo: 3.80 to 5.20%;
Nb+Ta: 1.80 to 2.80%;
Ti: 0.50 to 1.00%;
Al: 5.50 to 6.50%;
B: 0.005 to 0.015%;
Zr: 0.05 to 0.15%; and
Fe: 0.01 to 2.5%, with the remainder being Ni and unavoidable impurities, in which the turbine wheel includes a wing part and a shaft part, and a size of γ' phase in each site of from a tip of the wing part to the shaft part is structure-controlled so as to fall within a range of from 0.4 to 0.8 μm.

(2) The turbine wheel according to (1), which is produced by casting the Ni-based alloy and has an as-cast structure.

(3) The turbine wheel according to (1) or (2), which is produced by sucking a melt of the Ni-based alloy under reduced pressure into a porous mold produced by a lost wax process, followed by casting.

(4) The turbine wheel according to any one of (1) to (3), in which, in a whole turbine wheel, a size ratio between the most fine γ' phase and the most coarse γ' phase is 1.5 times or less.

(5) A method for producing the turbine wheel according to any one of (1) to (4), the method including casting the Ni-based alloy, in which a ratio of a volume of a melt of the Ni-based alloy sucked and cast in a mold which is arranged inside a casting chamber to a volume of the casting chamber is set to a range of from 2 to 10%, and a space around the mold in the casting chamber is filled with backup sand.

According to the present invention, a turbine wheel of an automotive turbocharger including a Ni-based alloy having high reliability of durability life in which stable high temperature strength is obtained and a method for producing the same can be provided.

DETAILED DESCRIPTION OF THE INVENTION

Figure 1:
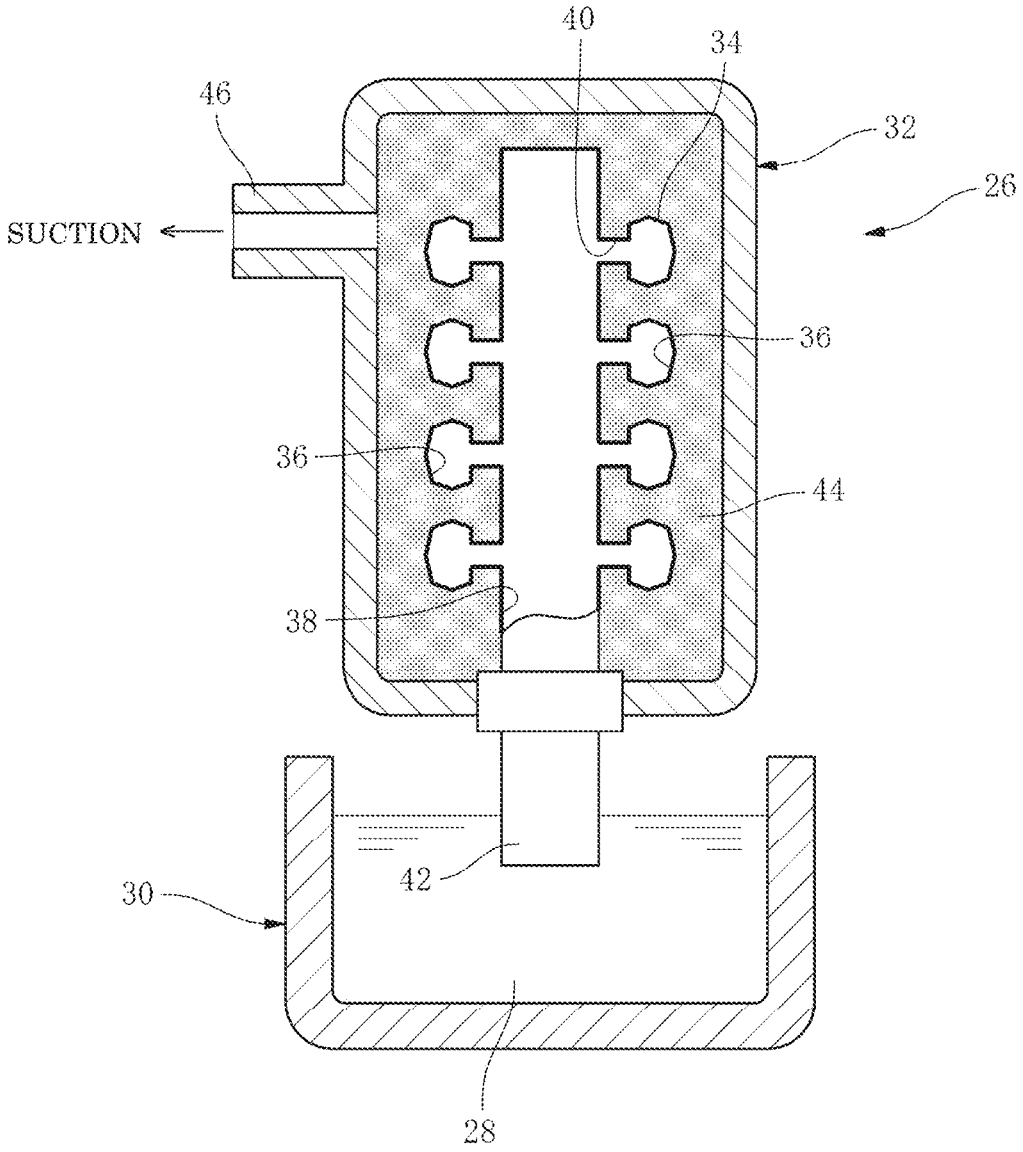
FIG. 1 is a view of reduced pressure suction casting facilities used in casting the turbine wheel of the present invention.

In a Ni-based alloy having a γ' phase as a strengthening phase, in the course of pursuing the cause that difference and deviation occur in high temperature strength of a turbine wheel, the present inventors have found that the difference of production conditions is great cause that produces difference and deviation in strength characteristics.

In the course of further detailed investigations, they have ascertained that a size of γ' phase greatly changes by the difference of production conditions, whereby strength and durability characteristics of a turbine wheel greatly change.

It is considered that a size of γ' phase is influenced by a cooling rate. However, in a turbine wheel, the thickness differs between a wing part and a shaft part. Furthermore, the wing part has a shape that the thickness is decreased toward a tip from a root portion of a center side, that is, the thickness variously differs in each site, and due to this, a cooling rate when cooling differs in each site due to the difference of thickness.

In the turbine wheel having such inherent circumstances, the present inventors have faced the problem as to what size the γ' phase should have in the whole turbine wheel.

In the course of proceeding further investigations as the above problem being new problem, the present inventors have found that a size of γ' phase in a range of from 0.4 to 0.8 μm is a proper range and as more preferred conditions, it is proper that a size ratio between the most fine γ' phase and the most coarse γ' phase is 1.5 times or less.

Namely, in the case where the γ' phase is too large or too small, durability characteristic is deteriorated.

In the case where a size of the γ' phase is too coarse, strength is decreased, and this leads to fatigue fracture by repeated stress during use. Alternatively, in the case where decrease of strength is remarkable, a turbine wheel does not withstand stress during use, and wing parts undergo plastic deformation. As a result, the wing parts come into contact with a turbine housing, leading to breakage.

On the other hand, in the case where a size of the γ' phase is too fine, strength is increased, but toughness and ductility become poor. As a result, brittle fracture is liable to cause in a stress loading part, and breakage is liable to occur during use.

In the case where there is remarkable difference in a size of γ' phase between a tip portion and a root portion of the wing parts, a portion having strength difference is further liable to be broken by stress concentration, for example, when a foreign matter collides with the wing parts during rotation (FOD; Foreign Object Damage).

Exhaust gas contains soot formed by combustion, or metal pieces generated by that metals rub to each other in an engine, and when those fly and collide with a turbine wheel, a portion having strength difference is further liable to be broken by stress concentration.

In the present invention, a size of the γ' phase is set to a range of from 0.4 to 0.8 μm, whereby high temperature strength characteristic of a turbine wheel can be stabilized, difference and deviation of durability life are suppressed, and reliability can be increased. Furthermore, in the present invention, a size ratio between a minimum size and a maximum size of the γ' phase is desirably set to 1.5 times or less.

In the present invention, control of a size of γ' phase can be conducted as follows.

As described before, a size of γ' phase precipitated during cooling in a turbine wheel changes by a cooling rate, a size tends to become fine as the cooling rate is fast, and a size tends to become large as the cooling rate is slow.

Furthermore, in a turbine wheel, a cooling rate is fast in a wing tip portion having small thickness and apart from the center, and on the other hand, a cooling rate is slow in the vicinity of a root of the wing parts near the center and the shaft part.

Therefore, in a turbine wheel, a size of γ' phase differs depending on the site under the conventional production conditions.

In general, a method of obtaining precipitates having target size and amount by holding at a temperature at which a precipitated phase again undergoes solid solution after casting to completely dissolve the precipitates in a matrix, and then conducting an aging heat treatment is general as a method of controlling a form and a precipitation amount of a precipitated phase such as γ' phase in a cast product.

However, those solid solution and aging treatments are possible in an alloy having low γ' solvus temperature (solid solution temperature), but in a Ni-based casting alloy represented by INCONEL 713C, the γ' solvus temperature is set to be high in order to increase a heat-resistant temperature during use, and in the case where γ' phase is tried to be completely subjected to solid solution in the solid solution treatment, local melting occurs. Therefore, structure control by the heat treatment is difficult.

Under the above circumstances, in order to optimally control a size of γ' phase of a turbine wheel obtained by casting, it is first necessary to optimize a mold temperature and a casting temperature.

In the case where the mold temperature is too low, a melt comes into contact with a mold, and since a cooling rate is too fast in a surface layer and the tip portion of wing parts that first coagulate, a size of γ' phase of the site becomes too fine.

On the other hand, in the case where the mold temperature is too high, a size of γ' phase becomes too coarse particularly in a shaft part in which coagulation is slow.

Similarly, in the case where the casting temperature is too low, a size of γ' phase becomes too fine, and on the other hand, in the case where the casting temperature is too high, the size thereof becomes too coarse.

In case of casting a turbine wheel, a size of γ' phase receives not only influence of a cooling rate when coagulating, but influence of a heat maintaining state thereafter.

For example, in reduced pressure suction casting in which a pressure in a mold is reduced and a melt is sucked into the mold by the pressure reduction, a mold is generally arranged in a reduced pressure chamber as a casting chamber, a space around the mold in the reduced pressure chamber is filled with sand (backup sand), and a pressure in the reduced pressure chamber is reduced to suck a melt into the mold, followed by casting. In such a case, heat of the melt transfers from the mold to the sand, heat is accumulated in the sand, and as a result, there is a case that coagulated metal in the mold is placed in a heat maintaining state.

Particularly, in the case where casting mass is large, a heat extraction amount to the reduced pressure chamber is increased. As a result, the temperature of the sand (backup sand) is greatly increased, and the coagulated metal is liable to be placed in a heat maintaining state.

When the mold and product are heat-maintained in a temperature region at which γ' phase precipitates, a size of γ' phase tends to become coarse.

In detail, in the case where casting mass of a product with respect to a volume of a reduced pressure chamber having a mold therein is too large, a heat extraction rate to the circumference of the mold becomes slow, and a size of γ' phase becomes too large even under the conditions of the same mold temperature and casting temperature. For this reason, in the case of increasing casting mass with respect to a volume of a reduced pressure chamber, it is necessary to relatively decrease a mold temperature and a casting temperature.

In the present invention, a ratio of a volume of a melt sucked and cast in a mold which is provided inside a casting chamber to a volume of the casting chamber is set to a range of from 2 to 10%, and casting can be conducted by filling a space around the mold in the casting chamber with backup sand.

Thereby, a heat maintaining state by backup sand can be made suitable to achieve that a size of γ' phase is a range of from 0.4 to 0.8 μm.

Regarding the ratio of the volume of the melt to the volume of the casting chamber, the range is more preferably from 3 to 8%, and still more preferably from 4 to 8%.

The problem of heat extraction is a problem caused not only in the case of reduced pressure suction casting but also in the case of conducting casting in the state that a space around a mold has been filled with sand (backup sand), even in gravity casting of pouring a melt in a mold by gravity. Therefore, also in this case, it is necessary to optimize casting mass for the purpose of controlling a size of γ' phase.

The present invention is particularly preferably applied to a turbine wheel that is cast using a Ni-based casting alloy by near net shape and is used with an as-cast structure.

Furthermore, the present invention is preferably applied to a turbine wheel produced by reduced pressure suction casting.

However, as the case may be, the present invention can be also applied to the case of producing a turbine wheel by forging. Even in the case of producing by forging, problems may arise that difference and deviation of high temperature strength are generated due to the large deviation of the size of γ' phase. In this case, characteristics can be improved by controlling a structure such that the size of γ' phase is arranged in a proper range.

The reason for limiting each component of the Ni-based alloy in the present invention is described below. Incidentally, the content of each component is shown in terms of mass %, and "mass %" is the same as "wt %".

C: 0.08 to 0.20%

C mainly forms MC or $M_{23}C_6$ carbide to improve grain boundary strength. In order to obtain sufficient high temperature strength, addition of 0.08% or more of C is required. However, excessive addition thereof forms coarse eutectic carbide and causes decrease of toughness and ductility. Therefore, the upper limit thereof is 0.20%.

Mn: 0.25% or less

In the case where Mn is added in a large amount, high temperature corrosiveness is deteriorated. Therefore, the upper limit of the content of Mn is 0.25%. The upper limit of the content of Mn is preferably 0.1%.

Si: 0.01 to 0.50%

Si has the effect of stabilizing an oxide coating film in a dense state under high temperature oxidation conditions. Therefore, Si may be intentionally added in an amount exceeding 0.01% that is an amount unavoidably contained. However, the addition thereof exceeding 0.50% deteriorates high temperature strength, and this is not preferred. The upper limit of the content of Si is preferably 0.25%.

Cr: 12.0 to 14.0%

Cr forms a dense oxide coating film including $Cr_2O_3$ on a surface to thereby improve oxidation resistance and high temperature corrosion resistance. In order to exert the characteristics, it is necessary to contain Cr in an amount of 12.0% or more.

However, in the case where it is excessively added, σ phase precipitates and ductility and toughness are deteriorated. Therefore, the upper limit thereof is 14.0%. The upper limit of the content of Cr is preferably 13.5% and the lower limit thereof is preferably 12.5%.

Mo: 3.80 to 5.20%

Mo has the effect of dissolving in an austenite phase and reinforcing a host phase by solid solution strengthening. In order to achieve the effect, Mo is required to be added in an amount of at least 3.80%. However, in the case where the amount thereof exceeds 5.20%, σ phase is liable to precipitate, and decreases toughness and ductility. Therefore, the upper limit thereof is 5.20%. The upper limit of the content of Mo is preferably 5.0% and the lower limit thereof is preferably 4.0%.

Nb+Ta: 1.80 to 2.80%

Nb and Ta dissolve in γ'-phase to strengthen the γ'-phase, and additionally forms an MC type carbide to strengthen grain boundary, thereby increasing creep strength. In order to obtain sufficient effect thereof, those are required to be added in an amount of 1.80% or more in total. However, addition of those in an amount exceeding 2.80% in total incurs coarsening of an eutectic carbide, and creep strength is rather decreased. Therefore, the upper limit thereof is 2.80%. Incidentally, any one of Nb and Ta may be contained in the Ni-based alloy, or both of them may be contained therein. The total content of Nb and Ta is preferably 2.0 to 2.8%.

Ti: 0.50 to 1.00%

Ti dissolves in γ'-phase to strengthen the γ'-phase, and has the effect of increasing creep strength by the addition of 0.50% or more. However, the addition thereof exceeding 1.00% increases an eutectic carbide to decrease ductility. Therefore, the addition amount thereof is up to 1.00%. The content of Ti is preferably 0.7 to 1.0%.

Al: 5.50 to 6.50%

Al forms γ'-phase ($Ni_3Al$ intermetallic compound) and greatly contributes to the improvement of high temperature strength. In order to obtain sufficient high temperature strength as a casting alloy for use as a turbine wheel, the addition of 5.50% or more of Al is required. However, in the case where the addition amount of Al is increased, creep strength is decreased. Therefore, the upper limit thereof is 6.50%. The upper limit of the content of Al is preferably 6.2% and the lower limit thereof is preferably 5.7%.

B: 0.005 to 0.015%

B is added in an amount of 0.005% or more in order to strengthen grain boundary. However, excessive addition of B forms a boride to decrease characteristics. Therefore, the upper limit thereof is 0.015%.

Zr: 0.05 to 0.15%

Zr improves creep strength by grain boundary strengthening, similar to B. However, excessive addition of Zr induces formation of a harmful phase and decrease of characteristics. Therefore, a proper range thereof is from 0.05 to 0.15%.

Fe: 0.01 to 2.5%

Fe is contained in the case where inexpensive alloy materials are used, for the purpose of decreasing alloy cost. Addition amount up to 2.5% of Fe does not give great influence to the characteristics as a turbine wheel, and such an amount of Fe may be contained. However, in the case where the addition amount thereof exceeds 2.5%, creep characteristic is decreased. Therefore, the upper limit thereof is 2.5%. The upper limit of the content of Fe is preferably 1.9%.

EXAMPLES

Examples of the present invention are described below.

Figure 3A:
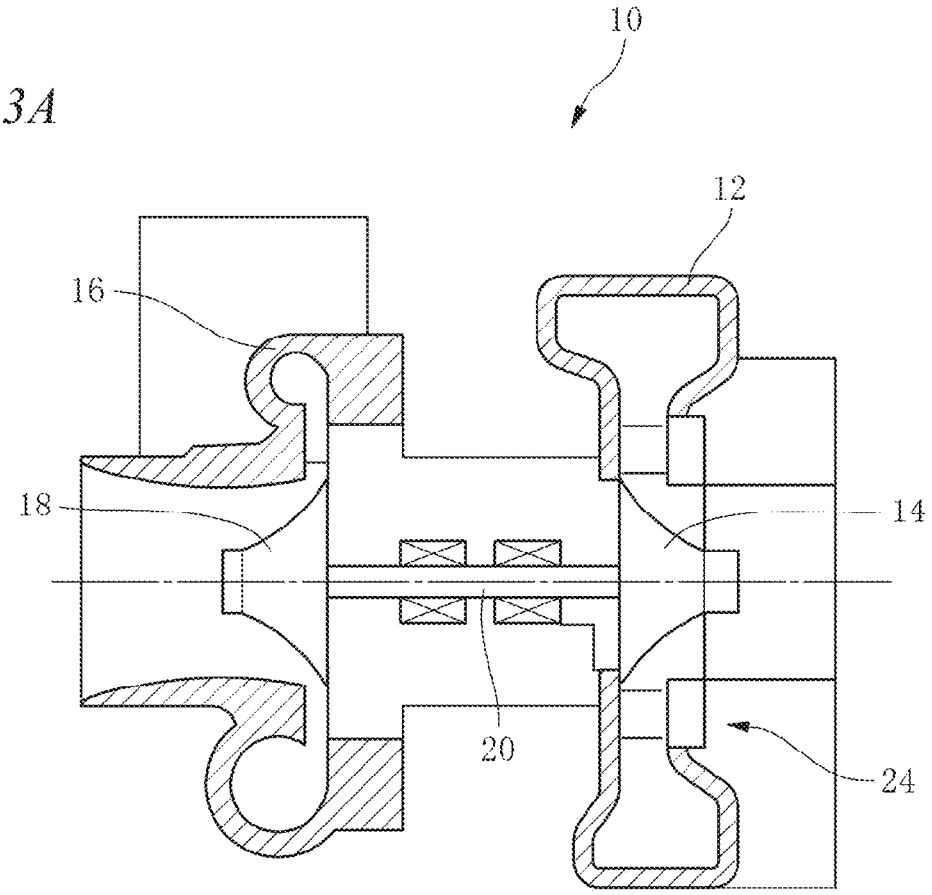
FIGS. 3A and 3B are views showing a structure of an automotive turbocharger.
Figure 3B:
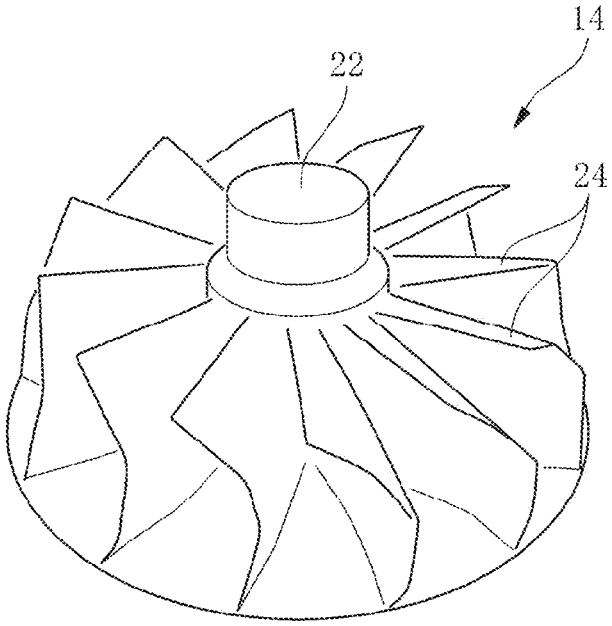

Using a Ni-based alloy having a composition of C: 0.1%, Mn: 0.03%, Si: 0.1%, Cr: 13.5%, Mo: 5.0%, Nb+Ta: 2.5%, Ti: 1.00%, Al: 6.0%, B: 0.010%, Zr: 0.08%, and Fe: 1.0%, with the remainder being Ni and unavoidable impurities, a turbine wheel 14 shown in FIG. 3B was cast by reduced pressure suction casting facilities 26 shown in FIG. 1.

In FIG. 1, 28 is a melt of a Ni-based alloy stored in a furnace 30, 32 is a reduced pressure chamber as a casting chamber, and 34 is a mold arranged therein. The mold 34 is a porous mold produced by a lost wax process.

36 is a cavity for molding a product in the mold 34, that is, a cavity for molding a turbine wheel shown in FIG. 3B, and 38 and 40 are a main passage and a branch passage, that suck the melt 28 and guide it to each cavity 36.

In the reduced pressure chamber 32, a space around the mold 34 is filled with sand (backup sand) 44.

Furthermore, the reduced pressure chamber 32 is equipped with a suction port 46 for vacuum-sucking (reduced pressure-sucking) the inside thereof.

The example shown in FIG. 1 is an example of reduced pressure suction casting in the atmosphere. The inside of the furnace 30 storing a melt melted in the atmosphere is opened to the atmosphere. The reduced pressure chamber 32 is allowed to go down in that state, a suction pipe 42 is dipped in the melt 28, and at the same time, the pressure in the reduced pressure chamber 32 is reduced by vacuum suction from the suction port 46.

As a result, the melt 28 is cast in the cavities 36 through the main passage 38 and the branch passage 40 from the suction pipe 42.

The melt coagulates in the mold 34, in detail, in the cavities 36, and after the reduced pressure chamber 32 is allowed to elevate, a product is taken out from the reduced pressure chamber 32 together with the mold 34.

Here, in the reduced pressure suction casting, total casting mass was from 15 to 20 kg, a volume of a melt occupied in a volume of a reduced pressure chamber as a casting chamber was from 5 to 7%, turbine wheels 14 having the same shape and the same size were cast by variously changing a mold temperature and a casting temperature, and respective sizes of γ'-phase in a root portion 24*a* and a tip portion 24*c* of a wing part 24 (see FIG. 2B) were examined. The results are shown in Tables 1 and 2.

Evaluation of a size of γ'-phase was conducted according to the following method.

<Evaluation of Size of γ'-Phase>

The turbine wheel was cut in a transverse section of the wing part 24 vertical to a rotating shaft of the turbine wheel 14, and embedded in a resin to prepare an observation sample, and an observation surface was mirror-polished.

Micro-observation sample prepared was subjected to electrolytic etching in 1% tartaric acid-1% ammonium sulfate aqueous solution with electric current of 25 $mA/cm^2$ for 4 hours to extract γ'-phase.

After electrolysis, a image of γ'-phase with a magnification of 30,000 times was obtained using SEM (scanning electron microscope).

In the image obtained, length of one side of a cubic γ'-phase was measured using an image processing software (Winroof of Mitani Corporation).

In detail, images of from 1 to 5 visual fields were taken in the respective sites, lengths of one side of arbitrary 15 γ'-phases were measured every visual field, and averaged, and the average values were further averaged in every visual field of the same site. The averaged value was used as a size of γ'-phase in the site.

TABLE 1

| Root portion | | | | | | | [μm] |
|---|---|---|---|---|---|---|---|
| | | Mold temperature (° C.) | | | | | |
| | | 800 | 900 | 1000 | 1100 | 1200 | 1300 |
| Casting temperature (° C.) | 1620 | 0.51 | 0.61 | 0.70 | 0.80 | 0.89 | 0.99 |
| | 1600 | 0.43 | 0.44 | 0.47 | 0.49 | 0.73 | 0.83 |
| | 1580 | 0.36 | 0.37 | 0.38 | 0.50 | 0.57 | 0.67 |
| | 1560 | 0.28 | 0.29 | 0.35 | 0.39 | 0.41 | 0.51 |
| | 1540 | 0.20 | 0.24 | 0.30 | 0.33 | 0.36 | 0.35 |

TABLE 2

| Tip portion | | | | | | | [μm] |
|---|---|---|---|---|---|---|---|
| | | Mold temperature (° C.) | | | | | |
| | | 800 | 900 | 1000 | 1100 | 1200 | 1300 |
| Casting temperature (° C.) | 1620 | 0.15 | 0.19 | 0.25 | 0.70 | 0.79 | 0.91 |
| | 1600 | 0.13 | 0.13 | 0.17 | 0.39 | 0.66 | 0.76 |
| | 1580 | 0.10 | 0.14 | 0.18 | 0.38 | 0.53 | 0.60 |
| | 1560 | 0.07 | 0.10 | 0.14 | 0.38 | 0.40 | 0.48 |
| | 1540 | 0.05 | 0.08 | 0.15 | 0.30 | 0.27 | 0.34 |

It is seen from the results of Table 1 and Table 2 that a size of γ' phase changes by changing a mold temperature and a casting temperature, and a size of γ' phase differs between a root portion and a tip portion of a wing part even under the same mold temperature and casting temperature.

Next, using Ni-based alloys having various compositions shown in Table 3, the turbine wheel 14 was prepared by reduced pressure suction casting by variously changing a melt volume occupied in a reduced pressure chamber volume (a ratio of a volume of a melt that is sucked and cast in a mold arranged in a reduced pressure chamber to a volume of the reduced pressure chamber), a total casting mass, a mold temperature and a casting temperature, a size of γ' phase of each site in the wing part 24 and the shaft part 22 was measured in the same method as above, and additionally, durability test was carried out in the following method.

TABLE 3

| | Chemical component (mass %, remainder: Ni) | | | | | | | | | | |
|---|---|---|---|---|---|---|---|---|---|---|---|
| | C | Si | Mn | Cr | Mo | Nb | Ti | Al | B | Fe | Zr |
| Alloy 1 | 0.10 | 0.10 | 0.03 | 13.5 | 5.0 | 2.5 | 1.00 | 6.0 | 0.010 | 1.0 | 0.08 |
| Alloy 2 | 0.15 | 0.25 | 0.10 | 12.5 | 4.4 | 2.0 | 0.70 | 5.7 | 0.010 | 0.3 | 0.10 |
| Alloy 3 | 0.13 | 0.15 | 0.05 | 13.8 | 5.1 | 2.7 | 0.90 | 6.2 | 0.010 | 0.7 | 0.12 |
| Alloy 4 | 0.15 | 0.10 | 0.05 | 13.1 | 4.1 | 2.6 | 0.90 | 5.9 | 0.010 | 0.9 | 0.09 |

<Durability Test>

The turbine wheel 14 experimentally produced was incorporated in a housing, and rotated by blowing a high temperature combustion gas from a combustor to the turbine wheel. Temperature of the combustion gas was set to about 950° C. on the assumption of use in a gasoline engine. The turbine wheel in which breakage was appeared during the test was recovered after the test, and the breakage portion was investigated.

The results are shown in Table 4.

TABLE 4

| | | Alloy used | Volume of melt occupied in volume of casting chamber [%] | Total casting mass [kg] | Mold temperature [° C.] | Casting temperature [° C.] | γ' phase maximum size [μm] | γ' phase minimum size [μm] | γ' phase maximum/minimum ratio | Durability test |
|---|---|---|---|---|---|---|---|---|---|---|
| Example | 1 | Alloy 1 | 6.3 | 18.2 | 1100 | 1600 | 0.49 | 0.47 | 1.0 | No breakage |
| | 2 | Alloy 1 | 6.9 | 19.5 | 1100 | 1590 | 0.56 | 0.53 | 1.1 | No breakage |
| | 3 | Alloy 1 | 6.3 | 18.2 | 1100 | 1580 | 0.50 | 0.40 | 1.3 | No breakage |
| | 4 | Alloy 1 | 6.0 | 17.6 | 1100 | 1570 | 0.42 | 0.41 | 1.0 | No breakage |
| | 5 | Alloy 1 | 6.8 | 19.2 | 1200 | 1590 | 0.65 | 0.60 | 1.1 | No breakage |
| | 6 | Alloy 1 | 8.2 | 24.6 | 1100 | 1540 | 0.57 | 0.53 | 1.1 | No breakage |
| | 7 | Alloy 1 | 6.3 | 18.2 | 1200 | 1570 | 0.49 | 0.47 | 1.1 | No breakage |
| | 8 | Alloy 1 | 6.3 | 18.2 | 1200 | 1560 | 0.41 | 0.40 | 1.0 | No breakage |
| | 9 | Alloy 1 | 8.8 | 18.2 | 1200 | 1540 | 0.74 | 0.64 | 1.2 | No breakage |
| | 10 | Alloy 1 | 6.1 | 10.2 | 1300 | 1580 | 0.67 | 0.60 | 1.1 | No breakage |
| | 11 | Alloy 1 | 6.1 | 11.2 | 1300 | 1570 | 0.59 | 0.51 | 1.1 | No breakage |
| | 12 | Alloy 1 | 5.8 | 15.8 | 1300 | 1560 | 0.51 | 0.48 | 1.1 | No breakage |
| | 13 | Alloy 1 | 4.8 | 16.2 | 1300 | 1550 | 0.47 | 0.42 | 1.1 | No breakage |
| | 14 | Alloy 2 | 6.3 | 18.2 | 1300 | 1580 | 0.65 | 0.59 | 1.1 | No breakage |
| | 15 | Alloy 2 | 6.3 | 18.2 | 1100 | 1580 | 0.49 | 0.40 | 1.2 | No breakage |
| | 16 | Alloy 3 | 6.3 | 18.2 | 1200 | 1560 | 0.40 | 0.41 | 1.0 | No breakage |
| | 17 | Alloy 3 | 6.3 | 18.2 | 1100 | 1600 | 0.53 | 0.45 | 1.2 | No breakage |
| | 18 | Alloy 4 | 6.3 | 18.2 | 1200 | 1600 | 0.67 | 0.57 | 1.2 | No breakage |
| | 19 | Alloy 4 | 6.3 | 18.2 | 1100 | 1600 | 0.50 | 0.42 | 1.2 | No breakage |
| Comparative Example | 1 | Alloy 1 | 6.1 | 18.2 | 750 | 1550 | 0.29 | 0.06 | 4.5 | Crack occurred in thin wall part |
| | 2 | Alloy 1 | 8.8 | 18.2 | 1200 | 1600 | 0.88 | 0.67 | 1.3 | Fatigue fracture of wing root portion |
| | 3 | Alloy 1 | 4.4 | 12.6 | 1300 | 1540 | 0.35 | 0.34 | 1.0 | Brittle fracture of wing root portion |
| | 4 | Alloy 1 | 6.3 | 18.5 | 1000 | 1580 | 0.38 | 0.18 | 2.1 | Crack occurred in thin wall part |

TABLE 4-continued

| | Alloy used | Volume of melt occupied in volume of casting chamber [%] | Total casting mass [kg] | Mold temperature [° C.] | Casting temperature [° C.] | γ' phase maximum size [μm] | γ' phase minimum size [μm] | γ' phase maximum/ minimum ratio | Durability test |
|---|---|---|---|---|---|---|---|---|---|
| 5 | Alloy 1 | 6.3 | 19.2 | 1000 | 1620 | 0.70 | 0.25 | 2.8 | Crack occurred in thin wall part |
| 6 | Alloy 2 | 6.3 | 18.2 | 900 | 1580 | 0.36 | 0.13 | 2.8 | Crack occurred in thin wall part |
| 7 | Alloy 3 | 6.3 | 18.2 | 900 | 1580 | 0.40 | 0.21 | 1.9 | Crack occurred in thin wall part |
| 8 | Alloy 4 | 6.3 | 18.2 | 900 | 1580 | 0.38 | 0.16 | 2.4 | Crack occurred in thin wall part |

In Comparative Examples 1 to 5 in Table 4, the turbine wheel 14 was cast using Alloy 1 in Table 3.

In Comparative Example 1, the maximum size of γ' phase is 0.29 μm, the minimum size thereof is 0.06 μm, and those sizes are smaller than the lower limit of the present invention. In addition, a ratio between the maximum size and the minimum size of γ' phase is 4.5, and is larger than 1.5 times or less that is the desirable size ratio in the present invention. As a result, in the durability test, crack occurred in a thin wall part of the wing part 24, and durability was insufficient.

In Comparative Example 3 and Comparative Example 4, both the maximum size and minimum size of the γ' phase are also smaller than 0.4 μm that is the lower limit of the present invention. Of those, in Comparative Example 4, a ratio between the maximum size and the minimum size of the γ' phase is 2.1 and is larger than 1.5 times or less that is the desirable size ratio in the present invention. As a result, in Comparative Example 3, brittle fracture occurred in the root portion 24*a* of the wing part 24, and in Comparative Example 4, crack occurs in a thin wall part of the wing part 24. Thus, durability was insufficient in those comparative examples.

In Comparative Example 5, the maximum size of γ' phase is 0.70 μm and falls within the range of the present invention, but the minimum size is 0.25 μm and is smaller than 0.4 μm that is the lower limit of the present invention. Furthermore, a ratio between the maximum size and the minimum size of the γ' phase is 2.8 and is larger than 1.5 times or less that is the desirable size in the present invention. As a result, in the durability test, crack occurred in the thin wall part, and durability was insufficient.

In Comparative Example 2, the maximum size of the γ' phase satisfies the requirement of the present invention, but the maximum size is 0.88 μm and is larger than 0.8 μm that is the upper limit of the present invention. As a result, fatigue fracture occurred in the root portion 24*a*, and durability was insufficient.

On the other hand, in Comparative Examples 6, 7 and 8, the turbine wheel 14 was cast using each of Alloys 2, 3 and 4 having compositions different from Alloy 1, respectively.

In Comparative Example 6 and Comparative Example 8, both the maximum size and minimum size of the γ' phase are smaller than 0.4 μm that is the lower limit of the present invention. In addition, a ratio between the maximum size and the minimum size of the γ' phase is larger than 1.5 times or less that is the desirable size ratio in the present invention. As a result, in those comparative examples, crack occurred in the thin wall part of the wing part 24, and durability was insufficient.

In Comparative Example 7, the maximum size of the γ' phase is 0.40 μm and falls within the range of the present invention, but the minimum size is 0.21 μm and is smaller than 0.4 μm that is the lower limit of the present invention. Furthermore, a ratio between the maximum size and the minimum size of the γ' phase is 1.9 and is larger than 1.5 times or less that is the desirable size ratio in the present invention. In the durability test, crack occurred in the thin wall part, and durability was insufficient.

In contract, Examples 1 to 19 in which the size of the γ' phase satisfies the requirement of the present invention use any of Alloys 1 to 4, but breakage did not occur in the durability test, and durability was sufficient.

Figure 2A:
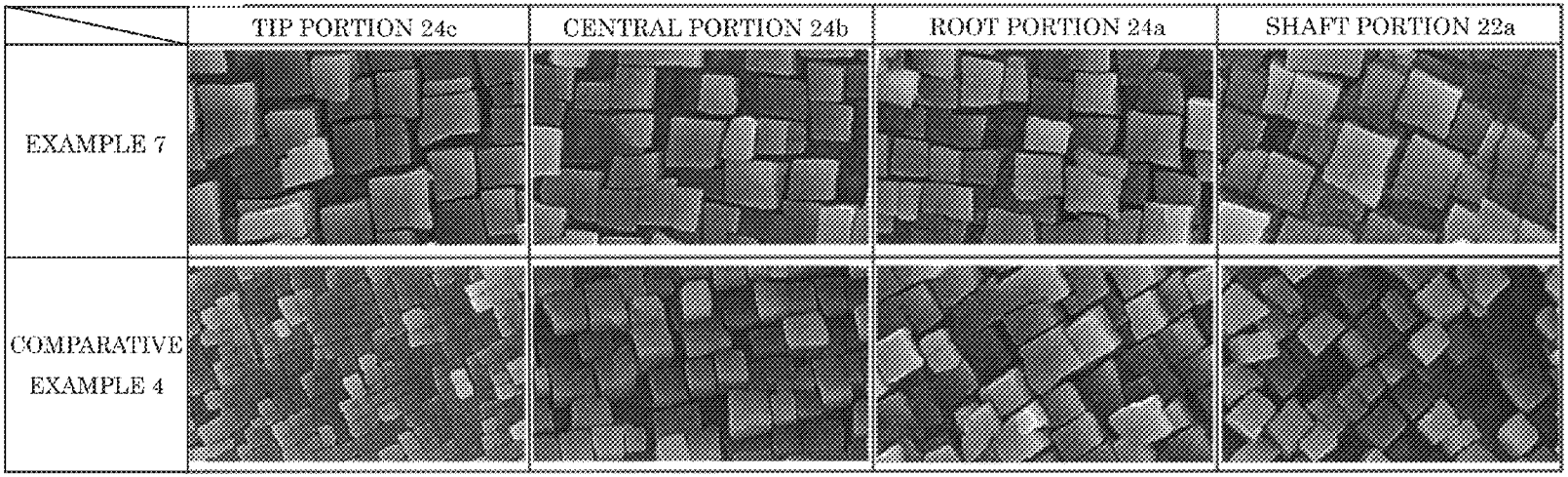
FIG. 2A is a view showing an SEM photograph of γ'-phase of each site in Example 7 together with Comparative Example 4 and FIG. 2B is a schematic view showing the observed sites thereof in the turbine wheel.
Figure 2B:
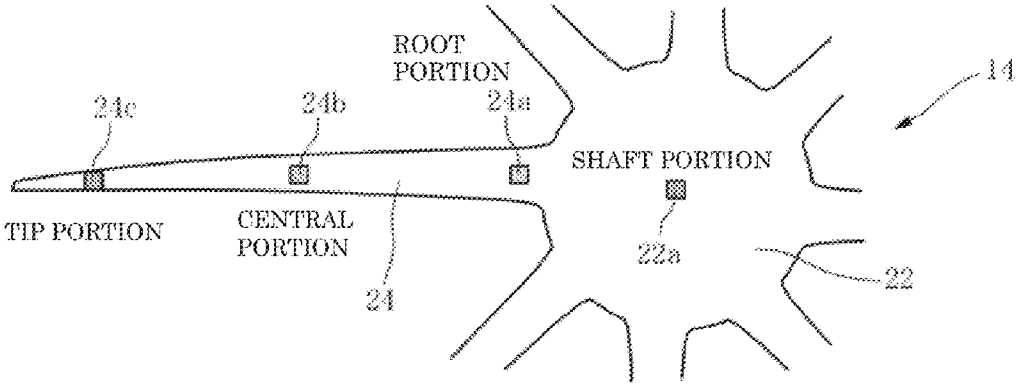

Incidentally, SEM images of the γ' phase remained after electrolytic extraction of the respective matrixes in Example 7 and Comparative Example 4 are shown in FIG. 2A (constant magnification of 30,000 times). It is seen from the images that the size of the γ' phase in the Example is uniform in each portion of the turbine wheel as compared with that in the Comparative Example.

The embodiment of the present invention is described in detail as above, but this is just one example.

For example, in reduced pressure suction casting, other than reduced pressure suction casting in the atmosphere exemplified above, it is possible in the present invention to conduct reduced pressure suction casting in vacuum in which spaces continued in a furnace is made to be vacuum state, raw material or ingot is melted to form a melt, and reduced pressure suction and casting are conducted through the reduced pressure chamber in the state that an inert gas such as Ar gas has been supplied to spaces continued in the furnace. Thus, the present invention can be carried out in the embodiment that various modifications have been added in a scope that does not deviate from the gist of the present invention.

The present application is based on Japanese Patent Applications No. 2014-039504 filed on Feb. 28, 2014 and No. 2014-252173 filed on Dec. 12, 2014, and the contents are incorporated herein by reference.

DESCRIPTION OF REFERENCE NUMERALS AND SIGNS

14: Turbine wheel

22: Shaft part

24: Wing part

28: Melt

32: Casting chamber (reduced pressure chamber)

34: Mold

44: Sand (backup sand)

What is claimed is:

1. A turbine wheel of an automotive turbocharger, comprising a Ni-based alloy having a composition which contains, in terms of mass %:

C: 0.08 to 0.20%;
Mn: 0.25% or less;
Si: 0.01 to 0.50%;
Cr: 12.0 to 14.0%;
Mo: 3.80 to 5.20%;
Nb+Ta: 1.80 to 2.80%;
Ti: 0.50 to 1.00%;
Al: 5.50 to 6.50%;
B: 0.005 to 0.015%;
Zr: 0.05 to 0.15%; and
Fe: 0.01 to 2.5%, with the remainder being Ni and unavoidable impurities, wherein the turbine wheel comprises a wing part and a shaft part, and a size of γ' phase in each site of from a tip of the wing part to the shaft part is structure-controlled so as to fall within a range of from 0.4 to 0.8 μm.

2. The turbine wheel according to claim 1, which is produced by casting the Ni-based alloy and has an as-cast structure.

3. The turbine wheel according to claim 1, which is produced by sucking a melt of the Ni-based alloy under reduced pressure into a porous mold produced by a lost wax process, followed by casting.

4. The turbine wheel according to claim 2, which is produced by sucking a melt of the Ni-based alloy under reduced pressure into a porous mold produced by a lost wax process, followed by casting.

5. The turbine wheel according to claim 1, wherein, in a whole turbine wheel, a size ratio between the most fine γ' phase and the most coarse γ' phase is 1.5 times or less.

6. The turbine wheel according to claim 2, wherein, in a whole turbine wheel, a size ratio between the most fine γ' phase and the most coarse γ' phase is 1.5 times or less.

7. The turbine wheel according to claim 3, wherein, in a whole turbine wheel, a size ratio between the most fine γ' phase and the most coarse γ' phase is 1.5 times or less.

8. The turbine wheel according to claim 4, wherein, in a whole turbine wheel, a size ratio between the most fine γ' phase and the most coarse γ' phase is 1.5 times or less.

9. A method for producing the turbine wheel according to claim 1, the method comprising casting the Ni-based alloy, wherein a ratio of a volume of a melt of the Ni-based alloy sucked and cast in a mold which is arranged inside a casting chamber to a volume of the casting chamber is set to a range of from 2 to 10%, and a space around the mold in the casting chamber is filled with backup sand.

10. A method for producing the turbine wheel according to claim 2, the method comprising casting the Ni-based alloy, wherein a ratio of a volume of a melt of the Ni-based alloy sucked and cast in a mold which is arranged inside a casting chamber to a volume of the casting chamber is set to a range of from 2 to 10%, and a space around the mold in the casting chamber is filled with backup sand.

11. A method for producing the turbine wheel according to claim 3, the method comprising casting the Ni-based alloy, wherein a ratio of a volume of a melt of the Ni-based alloy sucked and cast in a mold which is arranged inside a casting chamber to a volume of the casting chamber is set to a range of from 2 to 10%, and a space around the mold in the casting chamber is filled with backup sand.

12. A method for producing the turbine wheel according to claim 4, the method comprising casting the Ni-based alloy, wherein a ratio of a volume of a melt of the Ni-based alloy sucked and cast in a mold which is arranged inside a casting chamber to a volume of the casting chamber is set to a range of from 2 to 10%, and a space around the mold in the casting chamber is filled with backup sand.

13. A method for producing the turbine wheel according to claim 5, the method comprising casting the Ni-based alloy, wherein a ratio of a volume of a melt of the Ni-based alloy sucked and cast in a mold which is arranged inside a casting chamber to a volume of the casting chamber is set to a range of from 2 to 10%, and a space around the mold in the casting chamber is filled with backup sand.

14. A method for producing the turbine wheel according to claim 6, the method comprising casting the Ni-based alloy, wherein a ratio of a volume of a melt of the Ni-based alloy sucked and cast in a mold which is arranged inside a casting chamber to a volume of the casting chamber is set to a range of from 2 to 10%, and a space around the mold in the casting chamber is filled with backup sand.

15. A method for producing the turbine wheel according to claim 7, the method comprising casting the Ni-based alloy, wherein a ratio of a volume of a melt of the Ni-based alloy sucked and cast in a mold which is arranged inside a casting chamber to a volume of the casting chamber is set to a range of from 2 to 10%, and a space around the mold in the casting chamber is filled with backup sand.

16. A method for producing the turbine wheel according to claim 8, the method comprising casting the Ni-based alloy, wherein a ratio of a volume of a melt of the Ni-based alloy sucked and cast in a mold which is arranged inside a casting chamber to a volume of the casting chamber is set to a range of from 2 to 10%, and a space around the mold in the casting chamber is filled with backup sand.

* * * * *